US006637041B1

(12) United States Patent
Gutierrez et al.

(10) Patent No.: US 6,637,041 B1
(45) Date of Patent: Oct. 28, 2003

(54) TOILET TANK DISCHARGE DEVICE

(76) Inventors: José Blanco Gutierrez, Velázquez, 90-5°, 28006, Madrid (ES); Juan Sanz Luz, Velázquez, 90-5°, 28006, Madrid (ES)

( * ) Notice: Subject to any disclaimer, the term of this patent is extended or adjusted under 35 U.S.C. 154(b) by 0 days.

(21) Appl. No.: 10/202,233

(22) Filed: Jul. 24, 2002

(51) Int. Cl.[7] ..... E03D 1/14
(52) U.S. Cl. ..... 4/325; 4/410
(58) Field of Search ..... 4/324, 325, 378, 4/410

(56) References Cited

U.S. PATENT DOCUMENTS 4,566,140 A * 1/1986 Musgrove ..... 4/324
5,265,282 A * 11/1993 Schmucki ..... 4/325
5,720,053 A * 2/1998 Menge ..... 4/325
5,956,781 A * 9/1999 Grant ..... 4/325
6,163,897 A * 12/2000 Plas et al. ..... 4/410
6,442,772 B2 * 9/2002 Han et al. ..... 4/325

* cited by examiner

*Primary Examiner*—Charles E. Phillips
(74) *Attorney, Agent, or Firm*—Brown & Michaels, PC

(57) ABSTRACT

The present invention is a toilet tank discharge device, which includes a single deposit with two perfectly dosed and measured water lots, which depend on the specific use, in order to first give a determined quantity and subsequently, only in those cases when required by the user, the entire content of the deposit.

5 Claims, 2 Drawing Sheets

TOILET TANK DISCHARGE DEVICE

BACKGROUND OF THE INVENTION

1. Field of the Invention

The present invention refers to a tank discharge device which has quantified saving of water in toilets, performing a double discharge controlled by only one push button.

This invention is within the water saving systems in toilet deposits and tanks, and within them, among the purely mechanical devices using already known elements for actuating the water shut-off valve. It has a single deposit with two perfectly dosed and measured water lots, which depend on the specific use, in order to first give a determined quantity and subsequently, only in those cases when required by the user, the entire content of the deposit.

2. Description of Related Art

Different water saving devices in toilet tanks are known in the current state of the art. Those having two separated floats or a double water deposit are particularly known, actuated by means of a double push button or pull rod, such that different volumes are removed, depending on which float or deposit is used, which is a function of the actuated push button or pull rod.

Devices with a valve regulation mechanism depending on the pulsation intensity are also known, or with several valve opening diameters and of the regulation of the outlet liquid flow, or with a double water storage system producing a double stage upon actuating the push button, due to which a dragging of mechanical elements occurs once exceeding a certain point, giving way to the complete discharge.

Different types of buoys, adapters, more or less complex electric or electronic systems or other mechanisms regulating the water flow in tanks are also known.

One of the drawbacks that all of these known devices have is the difficulty of being adapted to the different types of existing toilets, so that the tank must incorporate the proposed mechanism in the majority of the cases. This implies a more expensive manufacturing process, in addition to the scarce usefulness of these systems.

On the other hand, other mechanisms do not have any structural consistency, so that even though they are adapted to the existing tanks, they deteriorate in little time. In addition, many of them do not adjust or fix the lid of the tank.

Another drawback of the known devices is that, although a significant water saving occurs by using these systems, the saving normally cannot be quantified. Some examples are those systems in which the water outlet valve is opened by pushing or pulling, and the water constantly flows towards the outlet while the push button or pull rod continues actuating; in other cases, it is necessary to produce a second pulsation in order to stop the outlet flow. Water saving does occur, but, definitively, exactly what quantity is not known, depending on the time it has been actuating in each case.

However, perhaps the biggest drawback of the current systems consists of it being fundamental to carry out a specific actuation in order to achieve a saving:

In single push button mechanisms where one pulsation actuates the water emptying and the second pulsation paralyzes the emptying, producing the saving depends on this second pulsation being carried out. In addition, it is not quantifiable since the amount of water emptied depends on the time elapsed between the first pulsation and the second one, which will be different each time.

In mechanisms of only one push button, which have two positions or a double pulsation run, it is necessary to choose the force or intensity with which the push button is actuated in order to save, or to not exceed a certain run in the pulsation, without being able to therefore ensure that with one push and release action, the force, intensity or run was correct in order to save water.

In mechanisms of a split push button or double push button, it is necessary to choose the part of the push button or which of the existing two must be actuated, saving water if finding the correct push button or the suitable part thereof.

Therefore, it depends on the user's will to produce the saving, and the second pulsation being carried out or not or correctly actuating the conservation mechanism is at the expense of carelessness, negligence, forgetfulness, unknowing or comfort.

There are even double discharge mechanisms with only one push button, in those which a first pulsation produces a partial discharge regardless of the torrent or pressure with which the water evacuates and therefore a forced and quantifiable water saving, but it is necessary to carry out a second pulsation that must also be maintained or continued for a period of time in order to produce the complete removal from the deposit.

SUMMARY OF THE INVENTION

The present invention overcomes the previously mentioned drawbacks in a simple manner, by means of only one water outlet valve, only one push button and one float. With a structurally heavy-duty device adaptable to any type of toilet tank, a measured and fixed volume of water is discharged by the action of pushing or pulling only once, while the complete discharge occurs when the push button or pull rod is actuated a second time in a prolonged manner. The system uses the coupling of simple mechanical devices physically separating on one side the opening and closing of the water outlet valve towards the toilet, and on the other, the filling of water in the system.

DETAILED DESCRIPTION OF THE INVENTION

Figure 1:
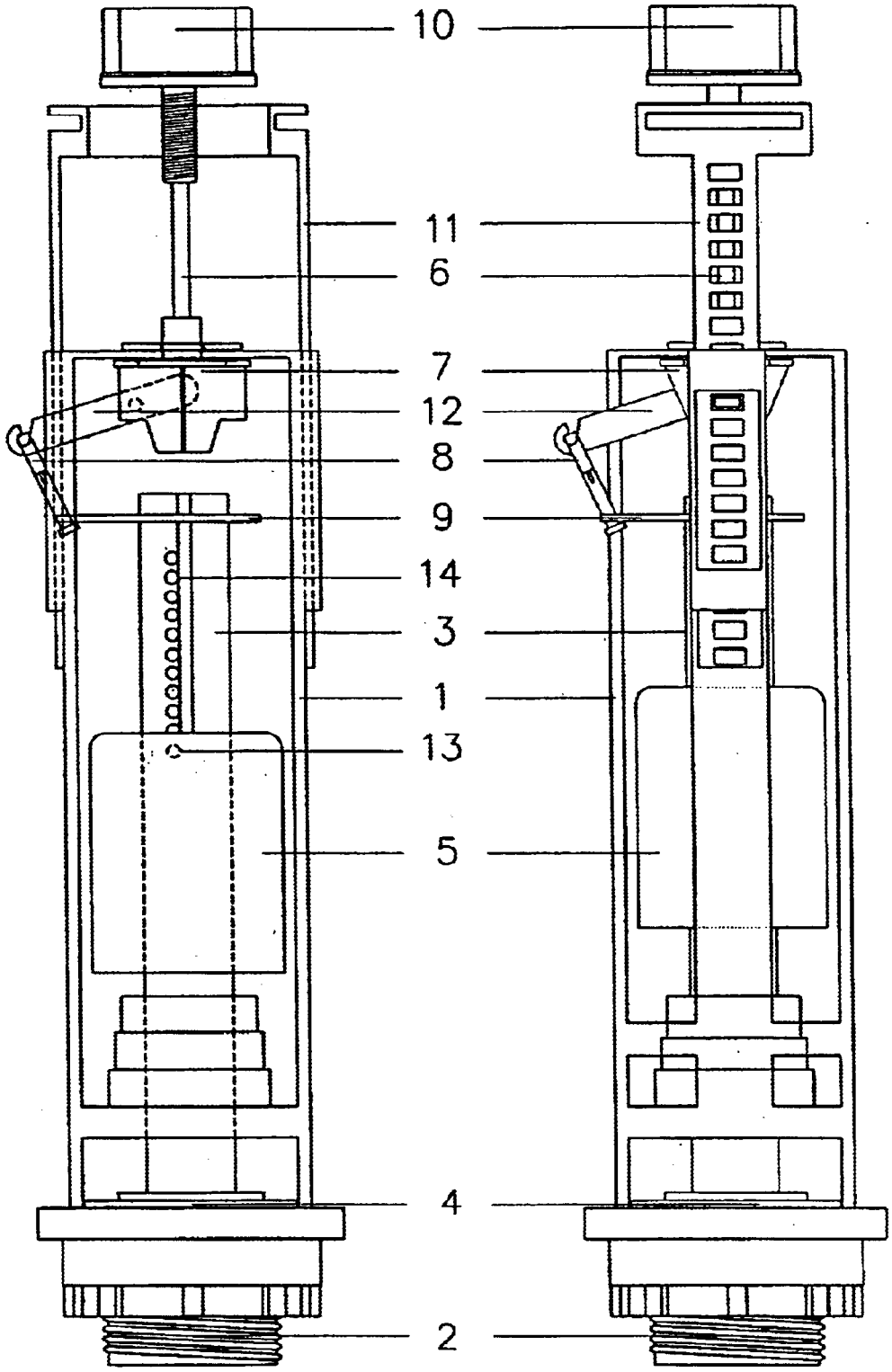
FIG. 1 shows respective front elevational and profile views of a toilet tank discharge device of the present invention.

The present invention functions like a forced saving system which could be called involuntary or intuitive saving once actuated, due to which actuating a push button or pull rod only once achieves the controlled discharge of a previously set volume of water, it being necessary to push a second time in a prolonged manner so that the complete discharge occurs.

The forced saving due to the previously quantified partial discharge occurs with the aid of a float arranged on the barrel tube at an intermediate height, such that by actuating the push button, the overflow barrel tube and the water shut-off valve are lifted, the latter actuated by the float, such that once a first pulsation is performed and once a certain amount of liquid has been evacuated, due to the evacuation of water, the float physically loses its suspension as the volume level drops when the outlet valve is opened. Due to the action of this float as well as its very weight, this gives way to a dragging of the tube assembly, causing the incorporated outlet valve to close.

By pushing and releasing only once, this limited and quantified volume of water is immediately discharged, and if the pulsation is not prolonged, the refilling of this volume occurs by the traditional systems and by means of the filling valve. This process with a limited and quantified volume of water can be repeated as often as desired by simply carrying out the action of only one pulsation.

In the case of wanting to remove all the water accumulated in the tank in addition to the limited volume, it is necessary to push, maintain the pulsation for a sufficient time, keeping the water outlet valve open until the entire volume of the tank is discharged.

In its assembly, the device has an adjustable pull rod or push button housed on the threading of a valve rocker and hooked with a pin. All these elements actuating in a chain reaction are responsible for opening the outlet valve. The float is assembled on the overflow barrel tube, where it is housed in an intermediate area which is a function of the desired volume of water to evacuate in the first discharge.

Structurally, there is an anchoring bridge for holding the lid of the tank, which can have a variable height depending on the tank where it is housed. There is also an anchoring bridge fixing mechanism by means of flukes, ensuring that the anchoring bridge has no mobility once the height is fixed, and the bridge can be moved only by pressuring the flukes on both sides of the mechanism. This definitively constitutes the assembly and disassembly system.

In the object of the invention, the water saving is preferably considered statistical or quantified in the sense that it is always the same without the possibility of varying the capacity once it is set.

The fact that some of the mechanisms used in the system are adjustable as well as adaptable to the tank gives way to the possibility that the set volume of water discharged when pushed only once can also be different according to the applications. Normally, the tank assembly includes a volume of approximately 10 liters of water. By pushing only once, preferably approximately 4 liters would be discharged, and the remaining only when pushed for a second time in a prolonged manner.

The system which produces the refilling through a water feeding valve connected to the tank is independent from the functioning described herein, although they must function in a synchronized manner since once a discharge occurs, the start of the tank filling must also occur. However, since both are independent, a partial discharge could be achieved by pushing only once and waiting the sufficient time until the tank refills, in the case that they are required again, as many partial discharges as desired. That is to say, it is not necessary to empty the tank assembly after a partial discharge.

Figure 2:
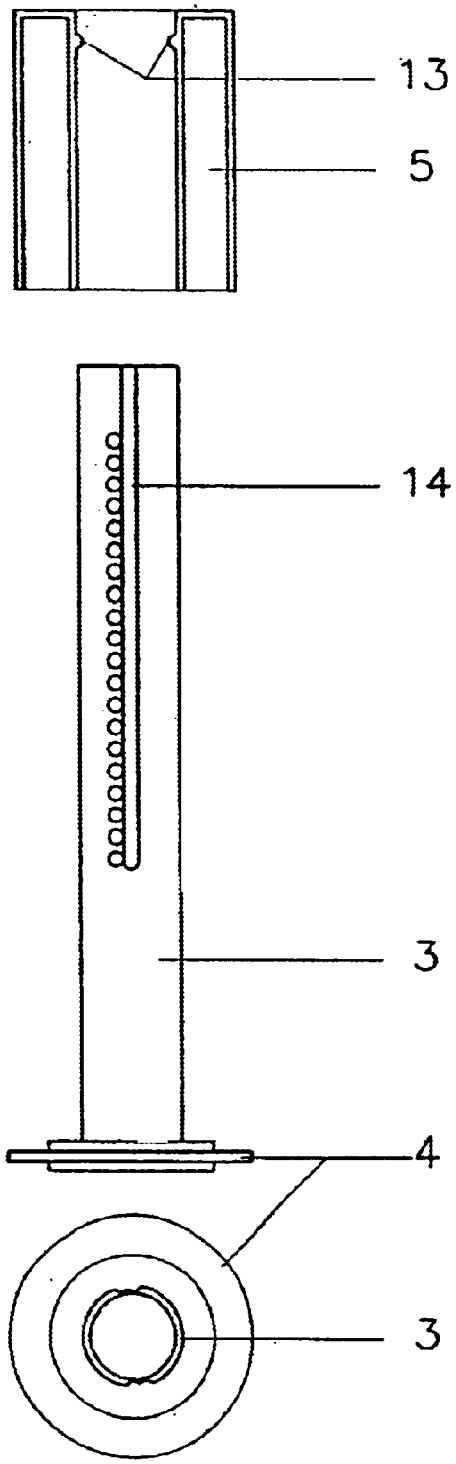
FIG. 2 shows respective views of a coupling system of the intermediate float on the overflow barrel tube.

Referring to FIGS. 1 and 2, the outer casing (1) of the device is constructed of a sufficiently resistant, resilient material which on the lower base has a union anchor (2) which is screwed into the lower hole of a standard tank. This casing (1) includes an anchoring bridge (11) for holding the lid of the tank by means of an adjustable rack, such that it can gradually be moved up and down until being adapted to any tank, regardless of its height, being fixed by means of several flukes so that no mobility exists once the height is determined. The assembly or disassembly of the bridge (11) could be carried out by exerting pressure on this system of flukes on both sides of the mechanism.

A threaded assembly with a valve rocker (7) symmetrically located in the center of the structure houses an adjustable pull rod (8) inside. The pull rod (8) is actuated from a connecting rod (12) and moves a pin (9). Since the pull rod is adjustable, it has the purpose of making the anchoring bridge for holding the lid of the tank likewise adjustable. By actuating a push button (10), the threaded assembly (7) is pushed through the shank (6), an actuation which is transmitted to the pin (9) and the latter pulls the tube (3) and closing disk (4) upwards, causing the outlet valve to open.

A float (5) is fixed at an intermediate height of the overflow barrel tube (3), such that by actuating a push button (10) and consequently the assembly associated to it, which will end in the pin (9) actuating the tube (3), it gives way to only one actuation of the push button shifting the barrel tube upwards and consequently opening the shut-off valve (4). If pressure is not applied while the discharge occurs, the barrel tube loses its ability to float as the water level descends to a level marked by the float (5) and it falls, the water outlet valve being closed. In this entire phase, the emptying of a controlled volume occurrs in function of the flotation capacity or force which is regulated by means of the float (5).

When the push button (10) is held down for a prolonged pulsation, the overflow tube (3) is maintained elevated and the shut-off valve (4) remains open until the complete volume discharge occurs.

The float (5) preferably has a cylindrical body with an axial hole in accordance with the outer diameter of the barrel tube (3) which it is coupled to by pressure. The float (5) is preferably internally provided with a small protruding pin (13) in correspondence with a series of vertically aligned notches (14) existing on the barrel tube (3), such that once introduced, once the float (5) is positioned at the required height, it is enough to turn it until the pin (13) coincides with one of the notches (14), thus retaining it in the desired position.

The device of the present invention is not affected in its functioning by the intensity, pressure or pulsation run, as it is carried out in a single push button in order for the partial or complete discharge of the water to occur.

The water filling mechanism after each emptying is carried out by means of a float actuating a valve located at the tank entrance, which is independent of the emptying processes, such that partial or complete discharges can alternately or consecutively occur in any order.

As has already been indicated, this device can be industrially applied as one of the control systems of toilet tank water outlet valves.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A toilet tank discharge device, comprising:

a) a push button; and b) an overflow barrel tube, comprising:

a discharge valve on a lower end of the barrel tube, wherein the push button actuates the barrel tube by shifting the barrel tube upwards in an opening, which propitiates an opening or closing of the discharge valve; and a float at an intermediate height which, once a certain quantity of liquid is evacuated, physically loses a suspension when a level drops due to an evacuation of water, which, combined with a weight of the device, gives way to the discharge valve closing, leaving the remaining volume of water in a tank;

wherein when the barrel tube is maintained elevated and the discharge valve remains open by performing a prolonged pulsation during a certain time, an evacuation of the entire volume of water contained in the tank occurs.

2. A device according to claim 1, wherein said float further comprises a coupling means onto the barrel tube which permits adjusting its height location, thus determining the volume of water emptied in a first pulsation.

3. A device according to claim 1, wherein said float further comprises a cylindrical body with an axial orifice in accordance with an outer diameter of the barrel tube which it is coupled to by pressure.

4. A device according to claim 1, wherein said float further comprises a cylindrical body with an axial orifice in accordance with an outer diameter of the barrel tube, provided with a small protruding pin in correspondence with a series of vertically aligned notches existing on the barrel tube such that once the float is positioned at the required height, the float turns until the pin coincides in one of said notches, which thus retains the float in a desired position.

5. A method of discharging water out of a toilet using a toilet tank discharge device comprising a push button, and an overflow barrel tube, comprising a discharge valve on a lower end of the barrel tube, wherein the push button actuates the barrel tube by shifting the barrel tube upwards in the opening, which propitiates an opening or closing of the discharge valve, and a float at an intermediate height which, once a certain quantity of liquid is evacuated, physically loses a suspension when a level drops due to an evacuation of water, which, combined with a weight of the device, gives way to the discharge valve closing, leaving the remaining volume of water in a tank, wherein when the barrel tube is maintained elevated and the discharge valve remains open by performing a prolonged pulsation during a certain time, an evacuation of the entire volume of water contained in the tank occurs, comprising the steps of:

a) performing a first instantaneous pulsation in order to cause a partial discharge of a predetermined amount of water; and b) performing a prolonged pulsation in order to cause a total discharge of the tank deposit.

* * * * *